US010890063B2

(12) United States Patent
Gunasekaran et al.

(10) Patent No.: US 10,890,063 B2
(45) Date of Patent: Jan. 12, 2021

(54) METHODS AND SYSTEMS EMPLOYING A CONDUCTIVE PATH WITH A SEGMENTATION MODULE FOR DECOUPLING POWER AND TELEMETRY IN A WELL

(71) Applicant: Halliburton Energy Services, Inc., Houston, TX (US)

(72) Inventors: Mohan Gunasekaran, Houston, TX (US); Pranay Asthana, Spring, TX (US); Paul Gregory James, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 262 days.

(21) Appl. No.: 15/754,855

(22) PCT Filed: Jan. 22, 2016

(86) PCT No.: PCT/US2016/014617
§ 371 (c)(1),
(2) Date: Feb. 23, 2018

(87) PCT Pub. No.: WO2017/127118
PCT Pub. Date: Jul. 27, 2017

(65) Prior Publication Data

US 2018/0347344 A1 Dec. 6, 2018

(51) Int. Cl.

| | |
|---|---|
| ***E21B 47/13*** | (2012.01) |
| ***E21B 41/00*** | (2006.01) |
| ***E21B 43/12*** | (2006.01) |
| ***E21B 47/12*** | (2012.01) |
| ***E21B 34/06*** | (2006.01) |
| ***E21B 47/06*** | (2012.01) |

(52) U.S. Cl.
CPC ..... *E21B 47/13* (2020.05); *E21B 34/066* (2013.01); *E21B 41/0035* (2013.01); *E21B 43/12* (2013.01); *E21B 47/06* (2013.01); *E21B 47/12* (2013.01)

(58) Field of Classification Search
CPC .... E21B 47/13; E21B 34/066; E21B 41/0035; E21B 43/12; E21B 47/06; E21B 47/12
USPC ..... 340/854.3
See application file for complete search history.

(56) References Cited

U.S. PATENT DOCUMENTS

2001/0013412 A1* 8/2001 Tubel ..... E21B 41/0035 166/250.01
2002/0020533 A1 2/2002 Tubel
(Continued)

FOREIGN PATENT DOCUMENTS

WO 2015167935 A1 11/2015
WO WO-2015167936 A1 * 11/2015 ..... E21B 47/125
WO 2017127118 A1 7/2017

*Primary Examiner* — Emily C Terrell
(74) *Attorney, Agent, or Firm* — Scott Richardson; Parker Justiss, P.C.

(57) ABSTRACT

A method includes deploying a tool in a well. The method also includes providing a conductive path with a segmentation module in the well. The method also includes conveying power and telemetry signals from a surface or uphole interface to the tool via the conductive path, where conveying the power and telemetry signals includes the segmentation module decoupling and later coupling power and telemetry signals conveyed along the conductive path.

20 Claims, 4 Drawing Sheets

(56) References Cited

U.S. PATENT DOCUMENTS

| | | | | |
|---|---|---|---|---|
| 2002/0121987 | A1* | 9/2002 | Besser | H01B 7/046 340/854.9 |
| 2008/0211687 | A1* | 9/2008 | Price | E21B 47/14 340/854.3 |
| 2013/0081807 | A1 | 4/2013 | Dyer et al. | |
| 2013/0327572 | A1 | 12/2013 | Sponchia et al. | |
| 2014/0085099 | A1* | 3/2014 | Menezes | E21B 17/028 340/855.1 |
| 2015/0002307 | A1* | 1/2015 | Graf | E21B 47/13 340/854.4 |
| 2015/0167452 | A1 | 6/2015 | Godager et al. | |
| 2016/0258284 | A1* | 9/2016 | Bittar | E21B 41/0035 |

* cited by examiner

METHODS AND SYSTEMS EMPLOYING A CONDUCTIVE PATH WITH A SEGMENTATION MODULE FOR DECOUPLING POWER AND TELEMETRY IN A WELL

CROSS-REFERENCE TO RELATED APPLICATION

This application is the National Stage of, and therefore claims the benefit of, International Application No. PCT/US2016/014617 filed on Jan. 22, 2016, entitled "METHODS AND SYSTEMS EMPLOYING A CONDUCTIVE PATH WITH A SEGMENTATION MODULE FOR DECOUPLING POWER AND TELEMETRY IN A WELL," which was published in English under International Publication Number WO 2017/127118 on Jul. 27, 2017. The above application is commonly assigned with this National Stage application and is incorporated herein by reference in its entirety.

BACKGROUND

Oilfield operating companies seek to maximize the profitability of their reservoirs. Typically, this goal can be stated in terms of maximizing the percentage of extracted hydrocarbons subject to certain cost constraints. A number of recovery techniques have been developed for improving hydrocarbon extraction. Some modern wellbores are multi-lateral wells, where lined and/or unlined lateral wells branch off from a main wellbore or branch.

For a multi-lateral well, maximizing the percentage of extracted hydrocarbons may involve deploying and controlling in-flow control device (ICD) or other tools in each of a plurality of lateral or sub-lateral branches. Without such control, the limited fluid flow capacity of a multi-lateral well can be negatively affected by lateral or sub-lateral branches that produce water or that cause negative hydrocarbon flows (due to pressure variations).

Providing power and telemetry to ICDs or other tools in a multi-lateral well is not a trivial task. For example, as the number of tools deployed in a multilateral frame work increases, the total amount of power needed and the complexity of power distribution to operate these tools increases. Further, communications between tools deployed in a multilateral frame work and earth's surface is an ongoing challenge that increases in complexity as the number of tools deployed in a multilateral frame work increases. Unlimited power is generally not available at production sites, and high-power solutions increase the likelihood of injury to operators at earth's surface. Further, the need for increased power, the need for signal amplification, and the likelihood of a break in conductive path continuity increases as a function of wellbore length. Further, work over operations (e.g., to maintain or repair a wellbore) often involve removing production tubing or other well components, which can affect conductive path continuity.

DESCRIPTION OF THE DRAWINGS

Accordingly, there are disclosed in the drawings and the following description methods and systems employing conductive paths with segmentation modules for decoupling power and telemetry in a multi-lateral well. In the drawings.

Figure 1:
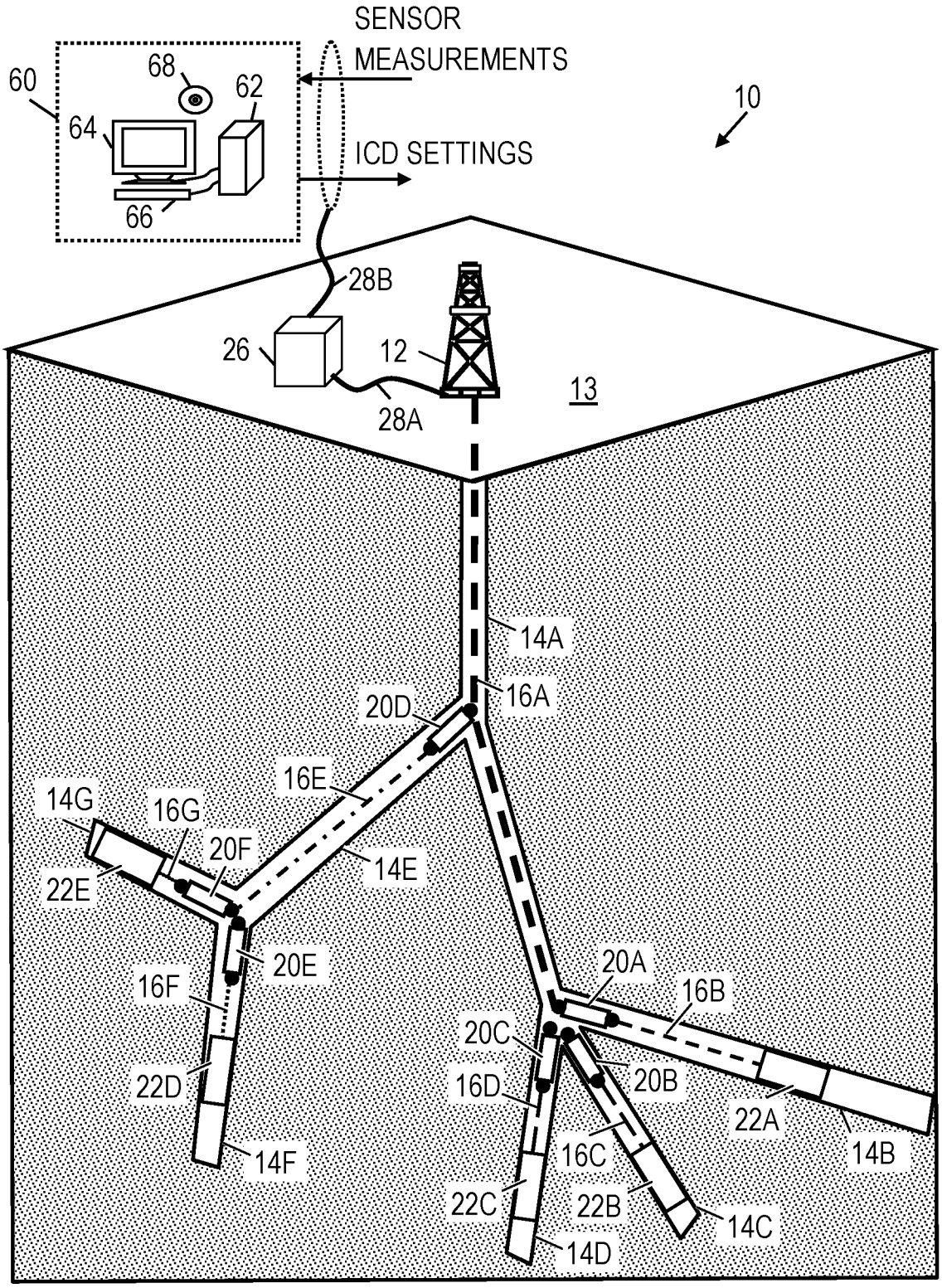
FIG. 1 is a schematic diagram showing an illustrative multi-lateral well scenario with segmentation modules.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Disclosed herein are methods and systems employing conductive paths with segmentation modules for decoupling power and telemetry in a multi-lateral well. The power and telemetry can be used to direct or collect data from in-flow control devices (ICDs) or other tools deployed in lateral or sub-lateral branches of the multi-lateral well. In at least some embodiments, the conductive paths and/or segmentation modules can be deployed downhole by being mounted to or attached to downhole tubular components (e.g., a production string and/or liners) deployed in the multi-lateral well. Each segmentation module can support various features such as adjusting decoupled power or telemetry signals (e.g., boosting a telemetry signal or changing the current/voltage levels of the power signals), or providing an on/off switch along a conductive path (e.g., at a junction of the multi-lateral well). Further, each segmentation module may enable disconnecting and reconnecting one of the conductive paths (e.g., at a junction of the multi-lateral well). As an example, the ability to disconnect and reconnect a conductive path enables removal of downhole tubular components deployed in a multi-lateral well for work over operations or other downhole operations. Once the downhole operations are completed, the same downhole tubular components or replacement downhole tubular components can be deployed again along with any conductive path components and/or connectors needed to reconnect a conductive path at a respective segmentation module that remains in the multi-lateral well.

In at least some embodiments, an example method includes deploying a plurality of tools in a multi-lateral well. The method also includes providing a conductive path with a segmentation module for each of a plurality of junctions of the multi-lateral well associated with one or more of the plurality of tools. The method also includes decoupling power and telemetry signals along at least one of the conductive paths using a respective segmentation module. The method also includes coupling decoupled power and telemetry signals along at least one of the conductive paths using a respective segmentation module. Meanwhile, an example system includes a plurality of tools deployed in a multi-lateral well. The system also includes a conductive path with a segmentation module for each of a plurality of junctions of the multi-lateral well associated with one or more of the plurality of tools, wherein at least one of the segmentation module decouples and later couples power and telemetry signals along its respective conductive path. Various options for segmentation module deployment, segmentation module components, segmentation module features, and segmentation module use in a multi-lateral well are disclosed herein.

FIG. 1 is a schematic diagram showing an illustrative multi-lateral well scenario 10 with segmentation modules 20A-20G. In scenario 10, surface equipment 12 at earth's surface 13 enables production and/or well intervention operations for a multi-lateral well having a main wellbore with an upper portion 14A and a lower portion 14B. Lateral wellbores 14C and 14D extend from the lower portion 14B of the main wellbore (or from the junction of the upper portion 14A and the lower portion 14B). Meanwhile, lateral wellbore 14E extends from the upper portion 14A of the main wellbore. Further, sub-lateral wellbores 14F and 14G extend from the lateral wellbore 14E.

In scenario 10, various conductive paths 16A-16G are represented. Without limitation to other embodiments, the conductive paths 16A-16G may correspond to tubing encased conductors (TECs) and suitable connectors. More specifically, the conductive path 16A extends along the upper portion 14A of the main wellbore, the conductive path 16B extends along the lower portion 14B of the main wellbore, the conductive path 16C extends along the lateral wellbore 14C, the conductive path 16D extends along the lateral wellbore 14D, the conductive path 16E extends along the later wellbore 14E, the conductive path 16F extends along the sub-lateral wellbore 14F, and the conductive path 16G extends along the sub-lateral wellbore 14G.

Each of the represented segmentation modules 20A-20F in scenario 10 is positioned between two of the conductive paths 16A-16G. More specifically, segmentation module 20A is between conductive paths 16A and 16B, segmentation module 20B is between conductive paths 16A and 16C, segmentation module 20C is between conductive paths 16A and 16D, segmentation module 20D is between conductive paths 16A and 16E, segmentation module 20E is between conductive paths 16E and 16F, and segmentation module 20F is between conductive paths 16E and 16G. While conductive paths 16A-16G are described in a segmented manner, it should be appreciated that when certain segmented conductive paths and segmentation modules are joined together, they form a continuous conductive path (e.g., extending between earth's surface and a particular tool).

In scenario 10, various tools 22A-22E are deployed in the multi-lateral well. The tools 22A-22E may correspond to ICDs or other tools used to control flow in either direction of a lateral or sub-lateral wellbore. Further, tools 22A-22E may include sensors to monitor ambient parameters such as pressure, temperature, flow rate, vibration, or other parameters. In scenario 10, tool 22A is deployed in the lower portion 14B of the main wellbore, tool 22B is deployed in the lateral wellbore 14C, tool 22C is deployed in the lateral wellbore 14D, tool 22D is deployed in the sub-lateral wellbore 14F, and tool 22E is deployed in the sub-lateral wellbore 14G. It should be appreciated that additional or fewer tools may be deployed in a multi-lateral well. For example, some lateral wellbores or sub-lateral wellbore of a multi-lateral well may include multiple tools or may have no tools deployed therein. Further, it should be appreciated that the type of tools deployed throughout different lateral and sub-lateral wellbores of a multi-lateral well may vary.

Regardless of tool type, the tools 22A-22E receive power and telemetry via respective conductive paths and segmentation modules. For example, tool 22A receives power and telemetry signals via conductive path 16A, segmentation module 20A, and conductive path 16B. Further, tool 22B receives power and telemetry signals via conductive path 16A, segmentation module 20B, and conductive path 16C. Further, tool 22C receives power and telemetry signals via conductive path 16A, segmentation module 20C, and conductive path 16D. Further, tool 22D receives power and telemetry signals via conductive path 16A, segmentation module 20D, conductive path 16E, segmentation module 20E, and conductive path 16F. Further, tool 22E receives power and telemetry signals via conductive path 16A, segmentation module 20D, conductive path 16E, segmentation module 20F, and conductive path 16G. The telemetry signals to the tools 22A-22E may correspond to flow control commands, sensor configuration commands, on/off commands, or other commands. It should be appreciated that the tools 22A-22E can also convey data or measurements to earth's surface via respective conductive paths and segmentation modules. Such data or measurements may be conveyed in response to a request, or in response to a schedule, trigger, or other programming.

Each of the segmentation modules 20A-20F enables various features such as receiving combined power and telemetry signals from a conductive path, decoupling the power and telemetry signals, adjusting decoupled power or telemetry signals (e.g., boosting a telemetry signal or changing the current/voltage levels of the power signals), transmitting the decoupled power and telemetry signals between components, coupling the transmitted power and telemetry signals, and outputting the coupled power and telemetry signals to a subsequent conductive path. The operations may correspond to uplink operations or downlink operations. Further, each of the segmentation modules 20A-20F may provide an on/off switch. Further, each of the segmentation modules 20A-20F may enable physical disconnection and later reconnection of two conductive paths. Further, the segmentation modules 20A-20F may include wireless transceivers and can communicate with each other wirelessly if within range of each other.

In at least some embodiments, a surface interface 26 couples to conductive path 16A to receive sensor measurements from the segmentation modules 20A-20F and/or the tools 22A-22E. Further, the surface interface 26 may provide power and telemetry for downhole operations involving the tools 22A-22E. Example components for the surface interface 26 include one or more power supplies, transmitter circuitry, receiver circuitry, data storage components, transducers, analog-to-digital converters, digital-to-analog converters. The surface interface 26 may be coupled to (e.g., via conductors 28A, 28B or wireless communication) or may include a computer system 60 that provides instructions for surface interface components, the segmentation modules 20A-20F, and/or the downhole tools 22A-22E. Further, the computer system 60 may process information received from the segmentation modules 20A-20F and/or the downhole tools 22A-22E. In different scenarios, the computer system 60 may direct the operations of the segmentation modules 20A-20F and/or the downhole tools 22A-22E. As an example, the computer system 60 may receive and analyze sensor measurements from the tools 22A-22E to determine ICD settings related to the tools 22A-22E. The computer system 60 may also display related information and/or control options to an operator. The interaction of the computer system 60 with the segmentation modules 20A-20F and/or the downhole tools 22A-22E may be automated and/or subject to user-input.

In at least some embodiments, the computer system 60 includes a processing unit 62 that displays logging/control options and/or results by executing software or instructions obtained from a local or remote non-transitory computer-readable medium 68. The computer system 60 also may include input device(s) 66 (e.g., a keyboard, mouse, touch-pad, etc.) and output device(s) 64 (e.g., a monitor, printer, etc.). Such input device(s) 66 and/or output device(s) 64 provide a user interface that enables an operator to interact with components of the segmentation modules 20A-20F, the downhole tools 22A-22E, and/or software executed by the processing unit 62.

Figure 2:
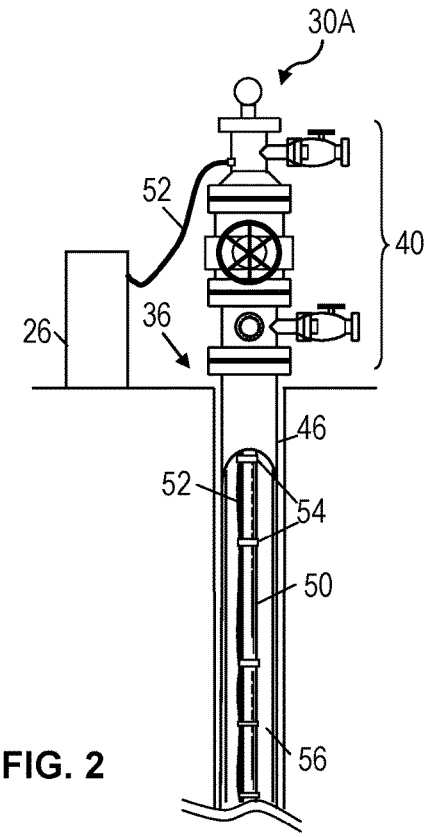
FIGS. 2 and 3 are schematic diagrams showing illustrative conductive path deployment options.
Figure 3:
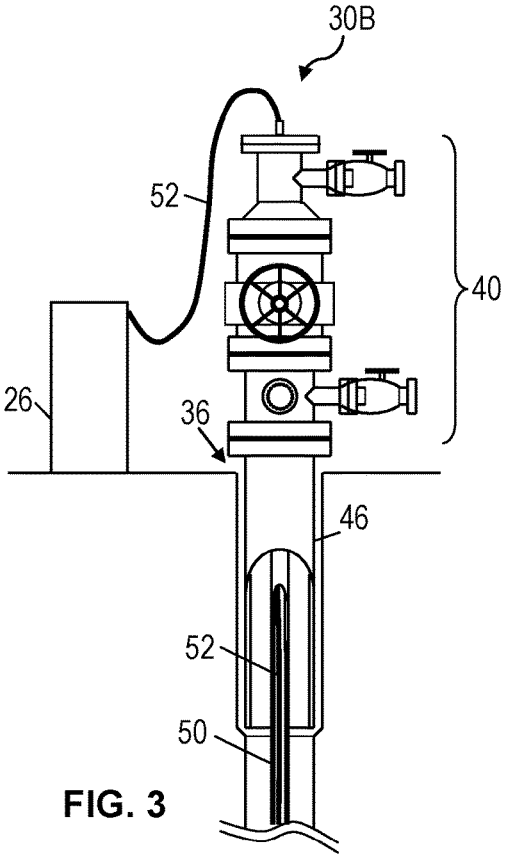

FIGS. 2 and 3 are schematic diagrams showing illustrative conductive path deployment options. In FIG. 2, conductive path deployment option 30A corresponds to a scenario where TEC 52 or another conductive path option is strapped to the outside of the production tubing string 50 by bands 54 that extend around the production tubing string 50. For example, the bands 54 may be applied to hold the TEC 52 to the production tubing string 50 as the string 50 is lowered into the casing string 46. Regardless of how the TEC 52 is attached to the production tubing string 50, the conductive path deployment option 30A of FIG. 2 corresponds to a scenario where the TEC 52 runs along the annular space 56 between the production tubing string 50 and a larger diameter casing string 46. Without limitation to other embodiments, the conductive path deployment option 30A shows a surface well assembly 40 installed at earth's surface. The surface well assembly 40 may correspond to a "Christmas tree" or other assembly of valves, spools, and fittings connected to a top of a well 36 to direct and control a flow of fluids to and from the well 36. In FIG. 2, the TEC 52 is shown to exit the surface well assembly 40 and extend to a surface interface 26 that provides downlink power and telemetry signals (e.g., for tools 22A-22E) and/or that processes uplink telemetry signals (e.g., from tools 22A-22E).

Figure 4:
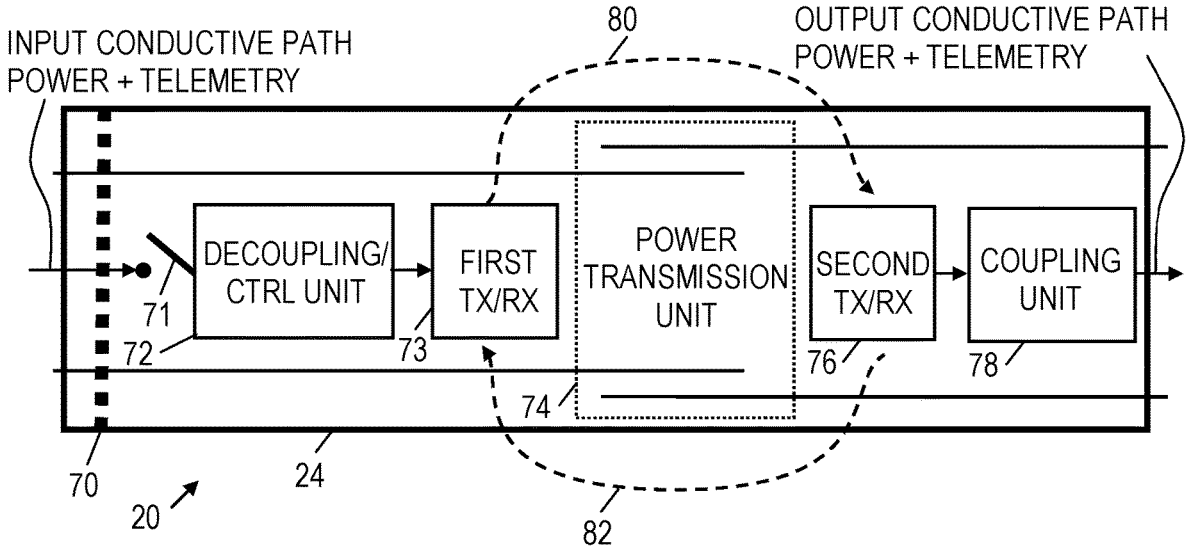
FIG. 4 is a block diagram showing an illustrative segmentation module.

In FIG. 3, conductive path deployment option 30B corresponds to a scenario where TEC 52 or another conductive path option runs along an interior of the production tubing string 50. For example, the TEC 52 may be inserted into the production tubing string 50 as the string 50 is lowered into the casing string 46. Without limitation to other embodiments, the conductive path deployment option 30B shows a surface well assembly 40 installed at earth's surface. The surface well assembly 40 may correspond to a "Christmas tree" or other assembly of valves, spools, and fittings connected to a top of a well 36 to direct and control a flow of fluids to and from the well 36. In FIG. 4, the TEC 52 is shown to exit the surface well assembly 40 and extend to a surface interface 26 that provides downlink power and telemetry signals (e.g., for tools 22A-22E) and/or that processes uplink telemetry signals (e.g., from tools 22A-22E). In at least some embodiments, surface interface 26 and related components may correspond to an uphole interface rather than an interface at earth's surface (i.e., power supply and telemetry components need not be at earth's surface). In different embodiments, an uphole interface can be used in addition to, or instead of, surface interface 26.

While FIGS. 2 and 3 represent deployment options along the interior of casing string 46, it should be appreciated that it is possible to deploy at some portions of a conductive path along the exterior of the casing string 46. For example, inductive coils and/or specialized casing segments can be used to convey power and telemetry signals from the exterior of the casing string 46 to its interior and vice versa. Such inductive coils can be considered to be part of a conductive path.

FIG. 4 is a block diagram showing an illustrative segmentation module 20. As shown, the segmentation module 20 includes a housing 24 (e.g., a canister or other container) and a plug interface 70. The plug interface 70 enables physical disconnection of the input conductive path from the segmentation module 20. In different embodiments, the plug interface 70 may include part of the housing 24 or may be integrated with the housing 24.

When plugged or unplugged, the housing 24 may provide a sealed compartment for the internal components. In some embodiments, any empty space within housing 24 may be occupied by fluid to comply with a pressure criterion. Once the fluid has filled any empty space, the housing 24 is sealed to prevent the fluid from leaking out of the housing 24. In at least some embodiments, the fluid corresponds to a chemically inert (non-corrosive), non-magnetic, electrically insulating fluid such as air. In other embodiments, the fluid corresponds to a chemically inert, non-magnetic, electrically insulating, non-compressible fluid to provide further structural resilience to high pressure such as distilled water. In yet another embodiment, the fluid corresponds to a chemically inert magnetic fluid such as ferrofluids. The magnetic fluid enhances the magnetic permeability inside the housing 24, which may increase signal-to-noise ratio (SNR) of short hop EM communications involving components inside the housing 24.

In different embodiments, the material(s) and thickness of the housing 24 may vary. In at least some embodiments, the housing 24 is configured to satisfy at least one of a predetermined temperature criterion, a predetermined pressure criterion, a predetermined corrosion resistance criterion, a predetermined size criterion, and a predetermined electromagnetic transmissibility criterion, though in at least some embodiments each of these are satisfied to support operation in hostile downhole environments. For example, with regard to the predetermined temperature criterion and pressure criterion, at least some housing embodiments enable internal operations at ambient temperatures greater than 175° C. and at ambient pressures greater than 35,000 psi. Further, the housing 24 may have high tensile and compressive strength to withstand high pressures and shearing forces due to fluid pumping (e.g., during cementing).

With regard to the corrosion resistance criterion, at least some housing embodiments are comprised of material(s) resistant to corrosion during standard well completion practices, including cementation, stimulation (e.g., steam injection, acidization), hydraulic fracturing. With regard to the predetermined size criterion, the housing 24 may have a width of less than 1 inch (2.54 cm) and preferably less than 0.5 inches (1.27 cm). The predetermined size criteria may vary depending on how the segmentation module 20 is to be deployed in a downhole environment. For example, if the segmentation module 20 is to be deployed in the space between a casing string and a production string, then the gap (annulus) between the casing string and the production string may be used to determine the size criteria for housing 24.

With regard to the electromagnetic transmissibility criterion, the housing 24 should be electromagnetically compatible with short hop EM communications involving components inside the housing 24. This electromagnetic transmissibility criterion implies that the housing 24 should not significantly attenuate EM signals used for short hop communications. Further, the material(s) for housing 24 would be electrically resistive if not insulating to not significantly attenuate the EM field being measured. The electromagnetic transmissibility is a measure of the transmission of an EM field through the housing 24 relative to the EM field that would be measured in the absence of the housing 24.

The housing 24 encloses various components including a decoupling/control unit 72 that receives power and telemetry signals from a conductive path, and that decouples the power and telemetry signals. For example, the power and telemetry signals can be decoupled using suitable inductive coils. The decoupling/control unit 72 may forward the decoupled telemetry signals to a first transceiver (TX/RX) 73 and may forward the decoupled power signals to a power transmission unit 74. In at least some embodiments, the decoupling/control unit 72 includes a controllable on/off switch 71 that opens or closes the path to convey power and telemetry signals through the segmentation module 20. In alternative embodiments, the on/off switch 71 can be positioned before or after the decoupling/control unit 72.

The first transceiver 73 operates to wirelessly transmit decoupled telemetry signals 80 to a second transceiver 76. For example, the first transceiver 73 and second transceiver 76 may each include an antenna and suitable control circuitry to enable short hop communications 80 between the first transceiver 73 and the second transceiver 76. Further, the first transceiver 73 and/or second transceiver 76 may include circuitry to amplify, filter, or otherwise modify the decoupled telemetry signals. The power transmission unit 74 operates to convey decoupled power signals through the segmentation module 20. In different embodiments, the power transmission unit 74 enables power transfer using inductive coils, acoustic transducers, capacitive electrodes, galvanic electrodes, or other power transfer options. Further, the power transmission unit 74 may include circuitry to amplify, filter, or otherwise modify the decoupled power signals. In some embodiments, the power transmission unit 74 can adjust the voltage and current levels conveyed to a tool deployed in a multi-lateral well. In at least some embodiments, the first transceiver 73, second transceiver 76, and power transmission unit 74 are configured to respectively convey decoupled telemetry and power signals in a manner that achieves maximum efficiency in both power and signal transmission. As appropriate to achieve maximum efficiency, different frequencies can be used to separately convey decoupled telemetry and power signals.

In different embodiments, a segmentation module 20 may be configured to convey decoupled power or telemetry signals wirelessly between a transmitter and a receiver. Additionally or alternatively, a segmentation module 20 may be configured to inductively convey decoupled power or telemetry signals between two coils. Additionally or alternatively, a segmentation module 20 may be configured to acoustically convey decoupled power or telemetry signals between two transducers. Additionally or alternatively, a segmentation module 20 may be configured to convey decoupled power or telemetry signals between capacitive electrodes. Additionally or alternatively, a segmentation module 20 may be configured to convey decoupled power or telemetry signals between galvanic electrodes.

The coupling unit 78 operates to couple the decoupled power and telemetry signals from other components of the segmentation module 20 (e.g., the power transmission unit 74 and the second transceiver 76). As an example, the coupling unit 78 may include inductive coils and/or other circuitry to couple the power signals and telemetry signals together. Once coupled, the power signals and telemetry signals are output from the segmentation module 20 along a conductive path as described herein. The power signals and telemetry signals output from the segmentation module 20 are propagated along a conductive path to a subsequent segmentation module or tool (e.g., tools 22A-22E).

While conveyance of power and telemetry signals is represented in FIG. 4 in a downlink direction, power or telemetry signals can be conveyed in the opposite direction (an uplink direction). For example, the segmentation module 20 may receive uplink data from a tool (e.g., one of tools 22A-22E) via a respective conductive path. In such case, the uplink data 82 may be transmitted from the second transceiver 76 to the first transceiver 72 and then output from the segmentation module 20 along a conductive path in an uplink direction (towards earth's surface). Circuitry of the segmentation module 20 (e.g., in the second transceiver 76 or the first transceiver 72) may amplify, filter, or otherwise modify the uplink signals.

Figure 5A:
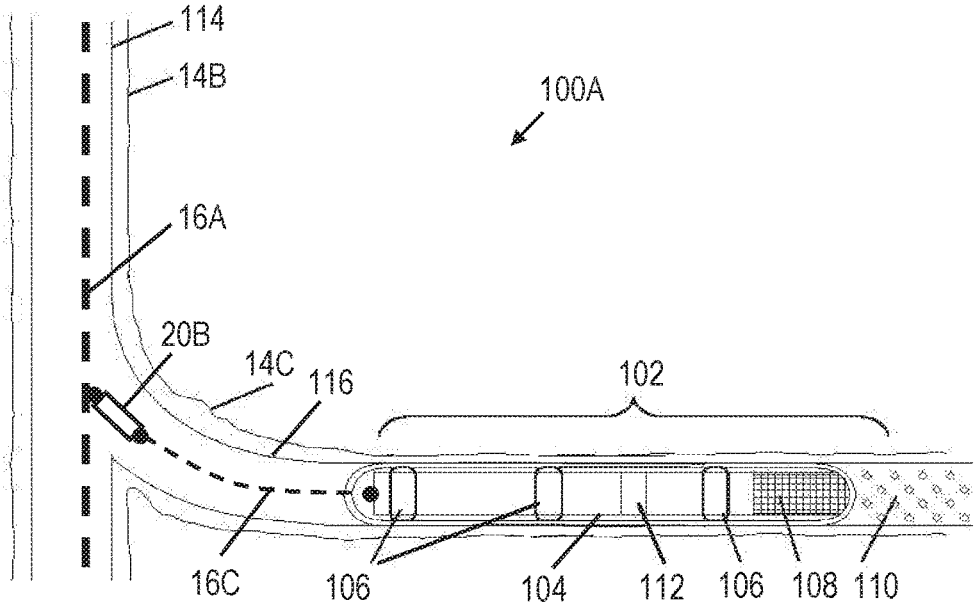
FIGS. 5A and 5B are schematic diagrams of illustrative lateral wellbores with in-flow control devices (ICDs)
Figure 5B:
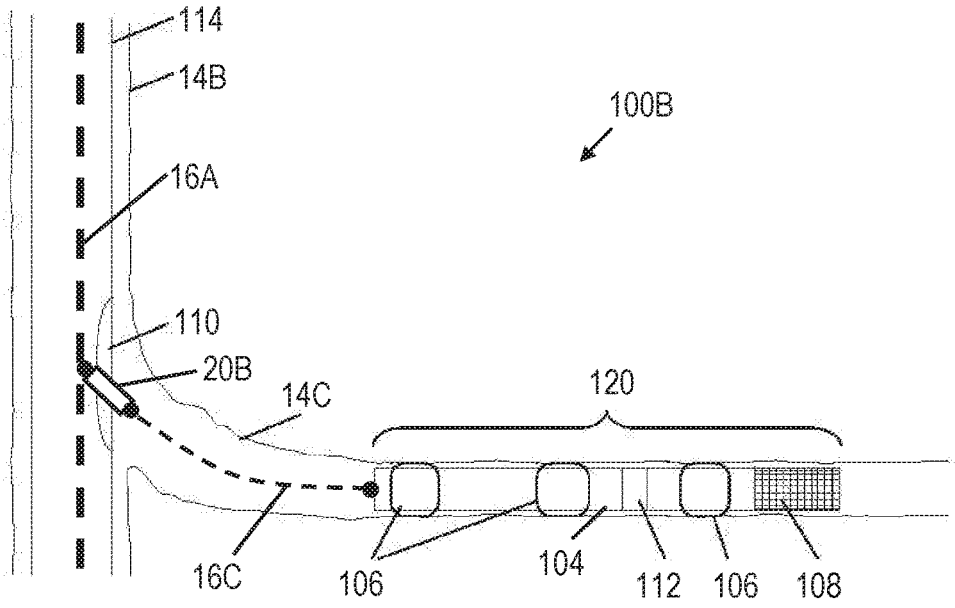

FIGS. 5A and 5B are schematic diagrams of illustrative lateral wellbores with ICDs. In scenario 100A of FIG. 5A, part of the multi-lateral well of FIG. 1 is represented. More specifically, lateral wellbore 14C is shown extending from lower portion 14B of the main wellbore, where respective casings strings or liners 114 and 116 are used to maintain the integrity of the lateral wellbore 14C and the lower portion 14B of the main wellbore.

As shown in scenario 100A, an ICD 102 is deployed at or near perforations 110 along the casings string or liner 116 of lateral wellbore 14C. The ICD 102 includes a tool body 104 and packers 106 that seal the lateral borehole against any flow other than that permitted through inlet 108 and tool body 104. The ICD 102 includes internal components 112 such as a controllable valve, actuators, sensors, electronics to direct valve and sensor operations, electronics to receive and transmit information, data storage, rechargeable batteries, and/or other components. At least some of the internal components 112 operate in accordance with power and/or telemetry signals received from earth's surface via conductive path 16A, segmentation module 20B, and conductive path 16C. Again, each segmentation module 20 supports various features such as receiving combined power and telemetry signals from a conductive path, decoupling the power and telemetry signals, adjusting decoupled power or telemetry signals (e.g., boosting a telemetry signal or changing the current/voltage levels of the power signals), transmitting the decoupled power and telemetry signals between components, coupling the transmitted power and telemetry signals, and outputting the coupled power and telemetry signals to a subsequent conductive path. Further, each segmentation module 20 may provide an on/off switch. Further, each segmentation module 20 may enable physical disconnection and later reconnection of two conductive paths.

As an example, ICD 102 may be equipped with various sensors for temperature, pressure, flow rates, and fluid properties. The collected sensor measurements are communicated via the conductive path 16C, the segmentation module 20B, and the conductive path 16A to earth's surface, where the collected measurements are analyzed or otherwise processed. In some embodiments, a computer system at earth's surface (e.g., computer system 60) may process the sensor measurements to determine appropriate valve settings. The valve settings and power needed to adjust the valve are provided (as power and telemetry signals) to the ICD 102 via the conductive path 16A, the segmentation module 20B, and the conductive path 16C. In response to the received power and telemetry signals, the ICD 102 sets its controllable valve. This process can be repeated periodically. Alternatively, the settings for the ICD 102 can be adjusted based on a schedule (regardless of sensor measurements), triggers (e.g., a sensor measurement exceeding a threshold value or a threshold rate of change value), or user input.

Scenario 100B of FIG. 5B is similar to the scenario 100A of FIG. 5A, except that there is no casing string or liner in lateral wellbore 14C. In other words, the ICD 120 in FIG. 5B is deployed in an open wellbore. The components and operations of the ICD 120 of FIG. 5B may be the same or are similar to the components and operations discussed for the ICD 102 of FIG. 5A.

Figure 6:
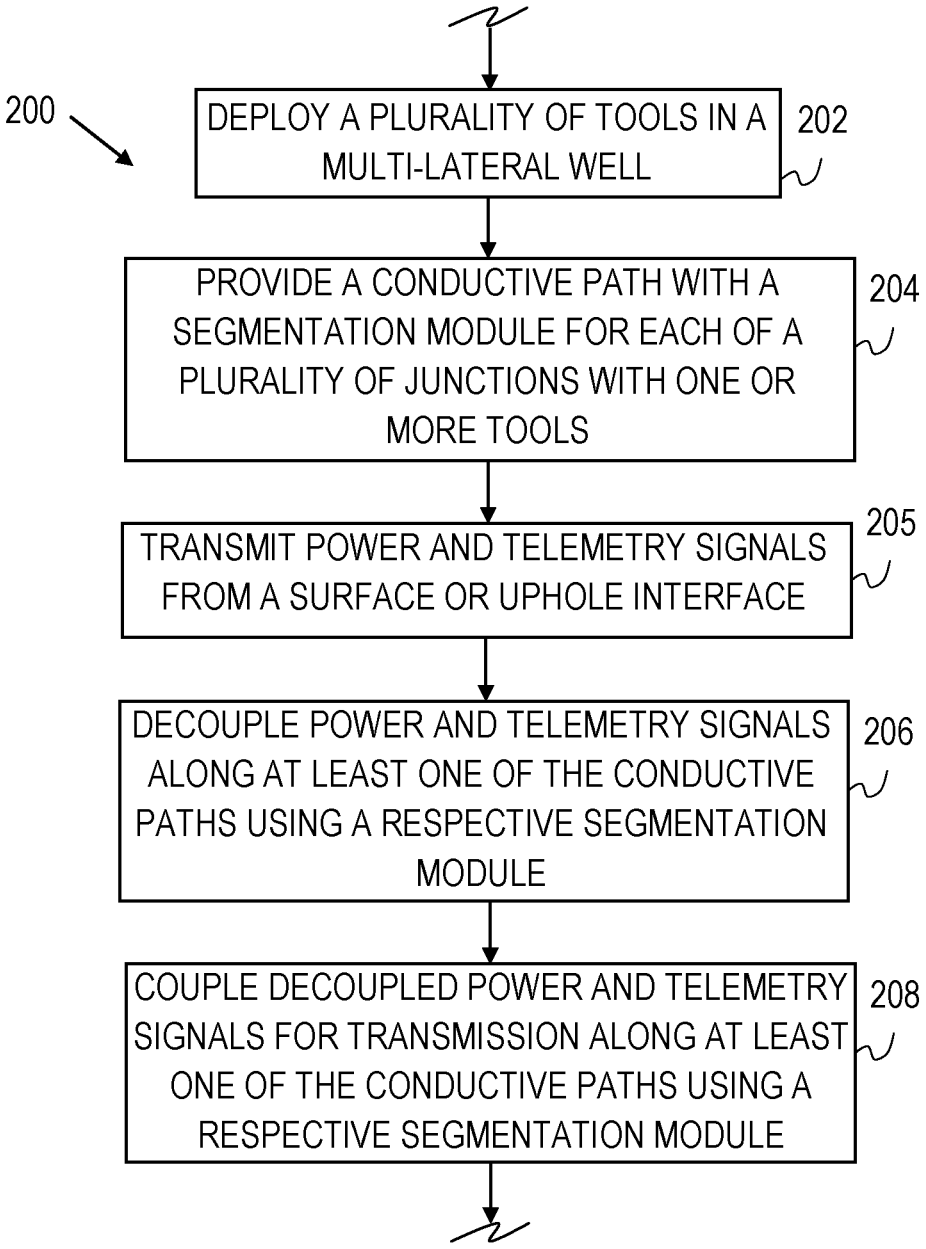
FIG. 6 is a flow chart showing an illustrative method involving conductive paths with segmentation modules for decoupling power and telemetry for multi-lateral well tools.

FIG. 6 is a flow chart showing an illustrative method 200 involving conductive paths with segmentation modules for decoupling power and telemetry for multi-lateral well tools. As shown, the method comprises deploying a plurality of tools in a multi-lateral well (block 202). The tools may be deployed in open wellbores or cased wellbores as described herein. At block 204, conductive path with a segmentation module is provided for each of a plurality of junctions with one or more of the tools. At block 205, power and telemetry signals are transmitted from a surface interface (e.g., surface interface 26). At block 206, the power and telemetry signals are decoupled along at least one of the conductive paths using a respective segmentation module. At block 208, the decoupled power and telemetry signals are coupled for transmission along at least one of the conductive paths using a respective segmentation module. In at least some embodiments, decoupled power or telemetry signals can be modified prior their being coupled again. For example, current/voltage levels of the power signals can be adjusted (e.g., the current level can be increased and the voltage level decreased by a segmentation module near a tool). In another example, telemetry signals can be amplified or filtered by one or more segmentation modules en route to a tool (or en route from a tool to earth's surface). The method 200 may additionally or alternatively include other operations related to the segmentation module features, tool features, data analysis features, and/or control features described herein.

Embodiments disclosed herein include:

A: A method that comprises deploying a tool in a well. The method also comprises providing a conductive path with a segmentation module in the well. The method also comprises conveying power and telemetry signals from a surface or uphole interface to the tool via the conductive path, wherein said conveying comprises the segmentation module decoupling and later coupling power and telemetry signals conveyed along the conductive path.

B: A system that comprises a tool deployed in a well. The system also comprises a conductive path with a segmentation module deployed in the well. The system also comprises a surface or uphole interface configured to transmit power and telemetry signals to the tool via the conductive path, wherein the segmentation module decouples and later couples power and telemetry signals conveyed along the conductive path.

Each of the embodiments, A and B, may have one or more of the following additional elements in any combination. Element 1: further comprising selectively disconnecting and reconnecting the conductive path at the segmentation module. Element 2: further comprising selectively switching off and switching on the conductive path at the segmentation module. Element 3: further comprising altering decoupled telemetry signals prior to said coupling. Element 4: further comprising altering decoupled power signals prior to said coupling. Element 5: further comprising conveying decoupled power or telemetry signals wirelessly between a transmitter and a receiver associated with the segmentation module. Element 6: further comprising inductively conveying decoupled power or telemetry signals between two coils associated with the segmentation module. Element 7: further comprising acoustically conveying decoupled power or telemetry signals between spaced transducers associated with the segmentation module. Element 8: further comprising conveying decoupled power or telemetry signals between capacitive electrodes associated with the segmentation module. Element 9: further comprising conveying decoupled power or telemetry signals between galvanic electrodes associated with the segmentation module.

Element 10: wherein the conductive path comprises at least one tubing encased conductor (TEC) coupled to the segmentation module. Element 11: wherein the segmentation module enables physical disconnection and reconnection of the conductive path. Element 12: wherein the segmentation module enables switching off and switching on of the conductive path. Element 13: wherein the segmentation module is configured to alter decoupled telemetry signals. Element 14: wherein the segmentation module is configured to alter decoupled power signals. Element 15: wherein the segmentation module is configured to convey decoupled power or telemetry signals wirelessly between a transmitter and a receiver. Element 16: wherein the segmentation module is configured to inductively convey decoupled power or telemetry signals between two coils. Element 17: wherein the segmentation module is configured to acoustically convey decoupled power or telemetry signals between two transducers. Element 18: wherein the segmentation module is configured to convey decoupled power or telemetry signals between capacitive electrodes. Element 19: wherein the segmentation module is configured to convey decoupled power or telemetry signals between galvanic electrodes.

Numerous variations and modifications will become apparent to those skilled in the art once the above disclosure is fully appreciated. For example, while multi-lateral well scenarios are described herein, it should be appreciated that one or more segmentation modules can be used in a single wellbore scenario. It is intended that, where applicable, the claims be interpreted to embrace all such variations and modifications.

What is claimed is:

1. A method that comprises:

deploying a tool in a well;

providing a conductive path with a segmentation module in the well; and conveying power and telemetry signals from a surface or uphole interface to the tool via the conductive path, wherein the conveying comprises the segmentation module:

decoupling the power and telemetry signals from the surface or uphole interface from each other;

separately conveying the decoupled power signals and the decoupled telemetry signals;

coupling the separately conveyed decoupled power and telemetry signals; and conveying the coupled power and telemetry signals along the conductive path to the tool.

2. The method of claim 1, further comprising selectively disconnecting and reconnecting the conductive path at the segmentation module.

3. The method of claim 1, further comprising selectively switching off and switching on the conductive path at the segmentation module.

4. The method of claim 1, further comprising altering the decoupled telemetry signals prior to the coupling.

5. The method of claim 1, further comprising altering the decoupled power signals prior to the coupling.

6. The method of claim 1, further comprising conveying the decoupled power or telemetry signals wirelessly between a transmitter and a receiver associated with the segmentation module.

7. The method of claim 1, further comprising inductively conveying the decoupled power or telemetry signals between two coils associated with the segmentation module.

8. The method of claim 1, further comprising acoustically conveying the decoupled power or telemetry signals between spaced transducers associated with the segmentation module.

9. The method of claim 1, further comprising conveying the decoupled power or telemetry signals between capacitive electrodes associated with the segmentation module.

10. The method of claim 1, further comprising conveying the decoupled power or telemetry signals between galvanic electrodes associated with the segmentation module.

11. A system that comprises:

a tool deployed in a well;

a conductive path with a segmentation module deployed in the well; and a surface or uphole interface that provides power and telemetry signals to the tool via the conductive path, wherein the segmentation module:

decouples the power and telemetry signals from the surface or uphole interface from each other;

separately conveys the decoupled power signals and the decoupled telemetry signals;

couples the separately conveyed decoupled power and telemetry signals; and conveys the coupled power and telemetry signals along the conductive path to the tool.

12. The system of claim 11, wherein the conductive path comprises at least one tubing encased conductor (TEC) coupled to the segmentation module.

13. The system of claim 11, wherein the segmentation module enables physical disconnection and reconnection of the conductive path.

14. The system of claim 11, wherein the segmentation module enables switching off and switching on of the conductive path.

15. The system of claim 11, wherein the segmentation module is configured to alter the decoupled telemetry signals.

16. The system of claim 11, wherein the segmentation module is configured to alter the decoupled power signals.

17. The system of claim 11, wherein the segmentation module is configured to convey the decoupled power or telemetry signals wirelessly between a transmitter and a receiver.

18. The system of claim 11, wherein the segmentation module is configured to inductively convey the decoupled power or telemetry signals between two coils.

19. The system of claim 11, wherein the segmentation module is configured to acoustically convey the decoupled power or telemetry signals between two transducers.

20. The system of claim 11, wherein the segmentation module is configured to convey the decoupled power or telemetry signals between capacitive electrodes.

* * * * *